United States Patent [19]

Carlson et al.

[11] 4,310,292

[45] Jan. 12, 1982

[54] HIGH SPEED ROTARY ATOMIZATION MEANS FOR MAKING POWDERED METAL

[75] Inventors: Russell L. Carlson, North Palm Beach; William H. Schaefer, Tampa, both of Fla.

[73] Assignee: United Technologies Corporation, Hartford, Conn.

[21] Appl. No.: 220,544

[22] Filed: Dec. 29, 1980

[51] Int. Cl.[3] ..... B01J 2/02

[52] U.S. Cl. ..... 425/8; 264/8

[58] Field of Search ..... 425/8; 264/8

[56] References Cited

U.S. PATENT DOCUMENTS 4,140,462 2/1979 Thompson ..... 425/8

4,207,040 6/1980 Metcalfe et al. ..... 425/8

*Primary Examiner*—James R. Hall

*Attorney, Agent, or Firm*—Stephen E. Revis

[57] ABSTRACT

A rotary atomization apparatus for making metal powders from liquid metals comprises an atomizer disk having a concave top surface for receiving a flow of molten metal thereon. The disk is preferably made from a high strength zirconium-containing copper base alloy. The disk is driven by a surrounding drive portion thru a radial spline-type connection. Higher rotational speeds than the prior art are the major advantage of this invention.

7 Claims, 4 Drawing Figures

FIG. 1
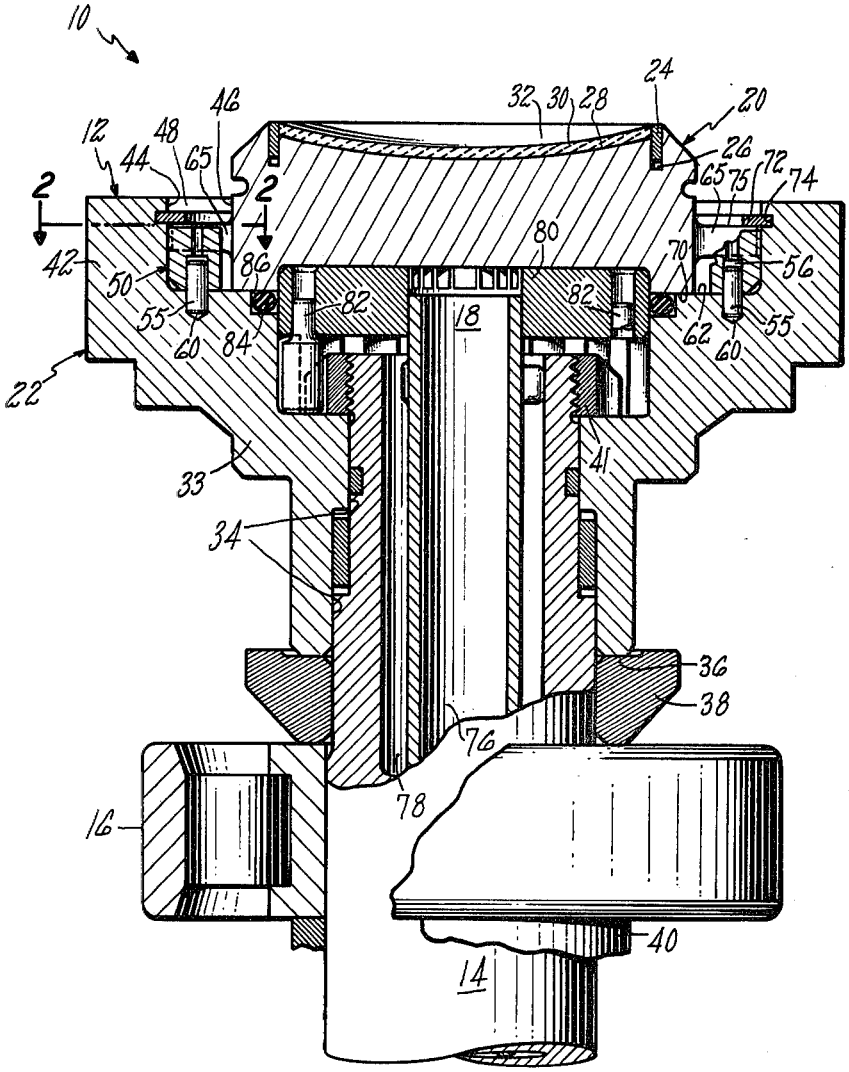
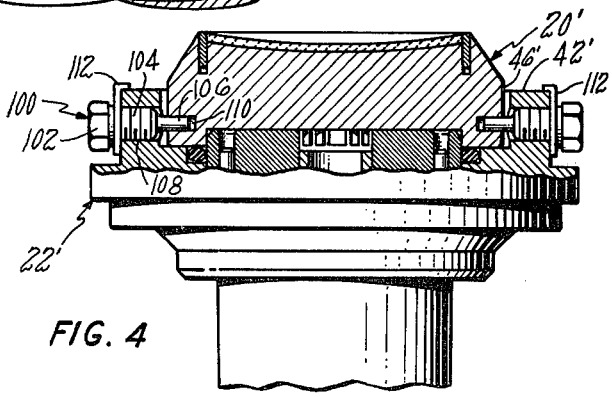
FIG. 4

HIGH SPEED ROTARY ATOMIZATION MEANS FOR MAKING POWDERED METAL

TECHNICAL FIELD

This invention relates to liquid metal rotary atomization apparatus for making metal powders.

BACKGROUND ART

Best representing the prior art in the field of the present invention are commonly owned U.S. Pat. No. 4,140,462 to Charles C. Thompson and U.S. Pat. No. 4,207,040 to Robert A. Metcalfe et al. In both of these patents the rotary atomization apparatus comprises a disk means fixedly mounted to the top of a drive shaft. The disk means is formed of a lower body portion and an upper disk. The upper disk is metal and has a concave, dish-shaped recess in its upper surface onto which a layer of ceramic material is disposed. A stream of molten metal is poured onto the center of the rotating ceramic surface of the upper disk and is broken up into fine droplets which are flung radially outwardly into a quenching chamber which rapidly cools them in a manner well known in the art and more completely described in commonly owned U.S. Pat. Nos. 4,025,249 and 4,053,264, incorporated herein by reference.

Returning to the Thompson patent and the Metcalfe et al. patent, it can be seen that the upper disk, lower body portion, drive shaft, and a generally cylindrical adapter member define a plurality of axially concentric, cylindrical, nesting elements. The lower body portion is fixed relative to the shaft by a plurality of radial bolts which pass through the body portion and through the intervening cylindrical adapter member directly into the shaft. The upper disk is secured to the lower body portion by means of an internally threaded hold down nut which threads onto the external surface of the lower body portion. The top of the hold down nut has an inwardly extending annular flange which engages the top surface of a radially extending flange of the upper disk. As the hold down nut is threaded onto the lower body portion it pulls the upper disk toward and against the lower body portion for the purpose of preventing relative motion therebetween.

There are several disadvantages with the foregoing arrangement. For example, the hold down nut can loosen due to centrifugal forces, vibration and differential thermal expansions. The upper disk can rotate relative to the lower body portion during assembly which can damage the O-ring seals provided therebetween for preventing cooling fluid from leaking from the coolant cavity within the rotating disk means. It is difficult to torque the hold down nut since there is no reaction torque, and there is no apparent way to lock the nut into position. Also, the hold down nut, upper disk, and lower body portions are not keyed to each other such that rebalancing would be required if the apparatus were disassembled. Finally, the apparatus of the Thompson and Metcalfe et al patents has been operated at RPMs no higher than about 35,000 RPM. It is desirable, however, to be able to spin the rotary atomization apparatus at about 50,000 RPM or even higher; and this is not within the capability of the prior art.

DISCLOSURE OF INVENTION

One object of the present invention is to provide rotary molten metal atomization apparatus with a higher RPM capability.

Another object of the present invention is to provide rotary molten metal atomization apparatus of improved design for insuring and maintaining the proper orientation of parts relative to each other.

Accordingly, improved rotary atomization apparatus comprises a disk means including disk for receiving a flow of molten metal on a top surface thereof, and a drive portion fixedly secured to a drive shaft. A plurality of radially directed elements interconnect the disk and the drive portion at a plurality of circumferentially spaced locations for providing a drive connection therebetween.

In a preferred embodiment the disk includes radially outwardly extending, circumferentially spaced teeth which engage radially inwardly extending circumferentially spaced teeth associated with said drive portion to define a radial spline. The radial spline provides positive driving of the disk with no relative rotation between the parts during assembly. The spline teeth provide simple means for positive indexing should the parts have to be disassembled and reassembled, such that rebalancing may be avoided. This type of drive connection also permits relative thermal growth between the driving and driven parts.

Most preferably, the disk is made from AMZIRC® copper alloy, a product of Amex Copper Inc. of New York, N.Y. This high strength copper alloy with a high thermal conductivity for effective cooling permits the use of much higher RPMs than the copper disks used in the prior art.

The foregoing and other objects, features and advantages of the present invention will become more apparent in the light of the following detailed description of the preferred embodiment thereof as shown in the accompanying drawing.

BRIEF DESCRIPTION OF THE DRAWING

FIG. 1 is a sectional view of a rotary atomizer according to the present invention.

FIG. 4 is a sectional view of a rotary atomizer according to another embodiment of the present invention.

BEST MODE FOR CARRYING OUT THE INVENTION

Figure 2:
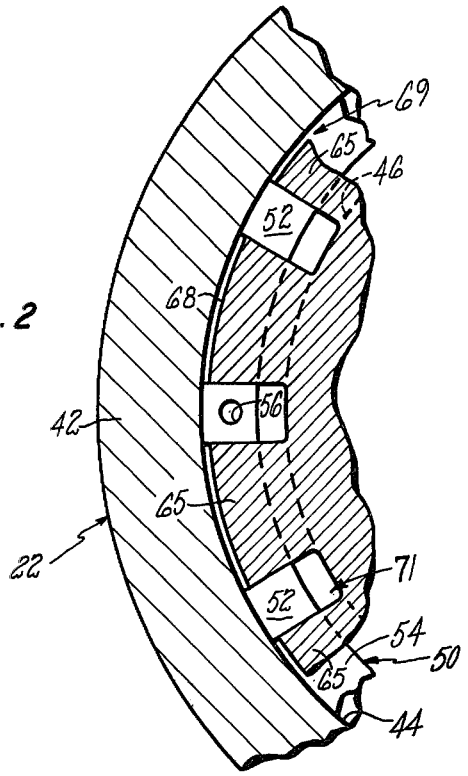
FIG. 2 is a sectional view taken along the line 2—2 of FIG. 1.
Figure 3:
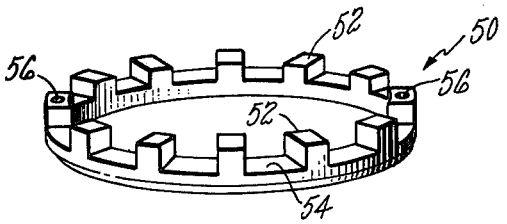
FIG. 3 is a perspective view of the drive ring element shown in FIGS. 1 and 2.

In the exemplary embodiment shown in FIGS. 1–3, the rotary atomization apparatus of the present invention is generally represented by the numeral 10. This atomization apparatus 10 comprises disk means 12 fixedly mounted to the top of a drive shaft 14. Only the top of the drive shaft is shown in the drawing, and it is supported by a bearing 16. The lower portion of the shaft is also mounted for rotation and can be rotated by any number of known means, such as by an electric motor or by an air turbine. The particular apparatus shown herein is designed to operate at least as high as 50,000 RPMs, but could, of course, be operated at lower RPMs.

Cooling means 18 is provided within said disk means 12 and drive shaft 14, and is of the type similar to that described in above-referred to U.S. Pat. No. 4,140,462, which is incorporated herein by reference. The cooling means 18 is not considered to be a part of the present invention.

The disk means 12 includes disk 20 and a drive portion 22. The disk 20 includes a metal ring 24 (material: IN-100) press fitted into a recess 26 around the outer circular periphery of a shallow, concave, upper surface 28 of the disk 20. The ring 24 extends upwardly slightly above the surface 28. A ceramic layer 30 of $MgZnO_3$ is applied to the surface 28 which is first coated with NiAl. The $MgZnO_3$ coating defines the top surface 32 of the rotary atomization apparatus. This surface receives the stream of molten metal during operation. The disk 20 is made from a zirconium-containing copper base alloy having high thermal conductivity and tensile properties, such as AMZIRC copper alloy. At 70° F. this alloy has a yield strength of 50,000 psi, and at 400° F. has a yield strength of 40,000 psi. This compares with a 10,000 psi and 7,000 psi yield strength for oxygen free high conductivity copper at 70° F. and 400° F., respectively, which was used by the prior art. The thermal conductivity of AMZIRC copper alloy is 212 $BTU/ft^2/ft/hr/°F.$, which is substantially constant within a temperature range of between room temperature and about 900° F. These properties of AMZIRC copper alloy permit the use of 50,000 RPM and possibly higher spin speeds unattainable using prior art materials and apparatus.

The drive portion 22 includes a lower cylindrical portion 33 having inwardly facing cylindrical surfaces 34 which fit tightly on the shaft 14. The downwardly facing lower end 36 of the drive portion rests upon a stackup of parts surrounding the shaft 14 and including spacers 38, 40 and the bearing 16. A spanner nut 41 threads onto the top of the shaft 14 and locks the stacked-up parts in position along the length of the shaft. The drive portion 22 also includes an upwardly extending cylindrical portion 42 which surrounds the lower part of the disk 20. An inwardly facing cylindrical surface 44 of the portion 42 is spaced from an outwardly facing cylindrical surface 46 of the disk 20 defining a toroidal cavity 48 therebetween. Disposed within the cavity 48 is a drive ring 50 which is best shown in FIGS. 2 and 3. The drive ring 50 has a plurality of circumferentially spaced teeth 52 formed therein which extend radially inwardly from the surface 44 of the drive portion 22 toward the surface 46 of the disk portion 20. The teeth 52 define slots 54 therebetween. The drive ring is fixed rotationally relative to the drive portion 22 by means of a pair of pins 55 disposed 180° apart which extend into pairs of corresponding holes 56 and 60 in the drive ring 50 and the drive portion 22, respectively.

The disk 20 includes a plurality of teeth 65 extending radially outwardly from the surface 46. As best seen in FIG. 2, these teeth are sized and spaced to fit into the slots 54 of the drive ring 50, thereby engaging the teeth 52 to form a radial spline which prevents relative rotation and allows radial growth between the ring 50 and the disk 20, and thus between the drive portion 22 and the disk 20. The spline also minimizes sideways shift between these parts. A loose fit at 69 between the radially outwardly facing cylindrical surfaces 68 of the teeth 65 and the inwardly facing cylindrical surface 44, and at 71 between the teeth 52 and the surface 46, permits some growth of the disk during operation. During assembly, a downwardly facing surface 70 of the disk 20 bears against an upwardly facing surface 62 of the drive portion 22 thereby vertically locating the disk 20. A lock ring 72 fits into a radially inwardly facing annular recess 74 in the surface 44 and extends radially inwardly over the teeth 65 of the disk 20. During operation coolant water pressure under the disk 20 forces the upper surfaces 75 of the teeth 65 against the bottom of the lock ring 72.

Returning, now, to the cooling of the disk means 12, a coolant inlet tube 76 carries coolant fluid therewithin up to the disk 20. The tube 76 is spaced by suitable means from the drive shaft 14 to define an annular coolant outlet passageway 78. Attached to the top of the coolant inlet tube 76 is a circular coolant baffle 80 which is substantially the same as that described as hereinabove referred to U.S. Pat. No. 4,140,462. The reader is referred to that patent for details concerning this baffle. The baffle serves the purpose of providing the necessary distribution and circulation of coolant to the disk 20 to prevent it from melting and to aid in maintaining the desired temperature of the molten liquid metal flowing onto the surface 32. A plurality of pins 82 simultaneously engage slots in the drive portion 22, in the spanner nut 41, and in the coolant baffle 80 such that relative rotation therebetween cannot take place and these parts all rotate together, along with the disk 20. An O-ring 84 is positioned in a recess 86 in the drive portion 22 adjacent the lower surface 70 of the disk 20 to prevent coolant fluid from escaping the coolant cavity 87.

FIG. 4 shows another embodiment of the present invention. Parts similar to those used in FIGS. 1–3 have the same but primed reference numerals. In essence, the difference between the embodiments of FIG. 1 and FIG. 4 is that in the embodiment of FIG. 4 radial pins take the place of the radial spline connection between the disk 20′ and the drive portion 22′. Thus, a plurality of threaded radial pins 100 are the elements which provide the driving force between the drive portion 22′ and the disk 20′, rather than drive ring 50 with its teeth 52. The pins, in this embodiment, comprise a bolt head 102, a threaded central portion 104, and a pin end 106. The upwardly extending cylindrical portion 42′ of the drive means 22′ includes a plurality of threaded radial holes 108 therethrough; while the disk 20′ includes a corresponding number of radial pin holes 110 in its outwardly facing cylindrical surface 46′. The holes 108 and 110 are aligned and the threaded pins 100 are inserted therein as shown. Tab lock washers 112 prevent the pins from coming out during operation and may be used for balancing. The pins 100 center the disk 20′ with respect to the drive portion 22′ and prevent both relative rotation and axial movement between the disk 20′ and the drive portion 22′.

Although the invention has been shown and described with respect to a preferred embodiment thereof, it should be understood by those skilled in the art that other various changes and omissions in the form and detail thereof may be made therein without departing from the spirit and the scope of the invention.

What is claimed is:

1. In a rotary atomization apparatus for receiving a stream of molten metal on a top surface for the production of solidified metal particles, said atomization apparatus comprising a drive shaft mounted for rotation, disk means disposed on the top of said drive shaft for rotation therewith, said disk means including a disk and a drive portion, said disk having a shallow, concave, upper surface having a cylindrical periphery, said drive portion being fixedly secured to said drive shaft, the improvement comprising:

said drive portion including an upwardly extending cylindrical portion surrounding said disk, drive means associated with said drive portion and fixed relative thereto including radially inwardly extending drive elements engaging said disk at a plurality of circumferentially spaced locations for providing a drive connection between said drive portion and said disk.

2. The apparatus according to claim 1 wherein said drive elements are a plurality of separate radial pins.

3. The apparatus according to claim 1 wherein said drive elements are a plurality of radially inwardly extending circumferentially spaced teeth, said disk including a plurality of outwardly extending circumferentially spaced teeth engaging said inwardly extending teeth forming a radial spline connection.

4. The apparatus according to claim 3 wherein said upwardly extending cylindrical portion has a radially inwardly facing annular recess located adjacent and above said inwardly extending teeth, a lock ring disposed in said recess, a portion of said lock ring extending radially inwardly over said radially outwardly extending teeth to axially locate said drive portion relative to said disk during operation.

5. The apparatus according to claim 3 wherein said drive means includes a drive ring fixed relative to said drive portion and disposed between said disk and said upwardly extending cylindrical portion of said drive portion, and said radially inwardly extending teeth are an integral part of said drive ring.

6. The apparatus according to claim 5 wherein said disk is a copper alloy containing zirconium.

7. The apparatus according to claim 5 including at least one vertically oriented pin extending between and engaging both said drive ring and drive portion to prevent relative rotation therebetween.

* * * * *